US008147024B2

(12) United States Patent
Jeon

(10) Patent No.: US 8,147,024 B2
(45) Date of Patent: Apr. 3, 2012

(54) INKJET IMAGE FORMING APPARATUS AND METHOD TO CONTROL THE SAME

(75) Inventor: Seong Nam Jeon, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 968 days.

(21) Appl. No.: 12/103,141

(22) Filed: Apr. 15, 2008

(65) Prior Publication Data

US 2008/0316237 A1 Dec. 25, 2008

(30) Foreign Application Priority Data

Jun. 22, 2007 (KR) ..... 10-2007-0061537

(51) Int. Cl.
*B41J 29/393* (2006.01)

(52) U.S. Cl. ..... 347/19; 347/38

(58) Field of Classification Search ..... 347/22–35, 347/38, 19

See application file for complete search history.

(56) References Cited

U.S. PATENT DOCUMENTS

| | | | | |
|---|---|---|---|---|
| 5,184,147 | A * | 2/1993 | MacLane et al. | 347/30 |
| 5,428,380 | A * | 6/1995 | Ebisawa | 347/35 |
| 5,519,418 | A * | 5/1996 | Nishikawa et al. | 347/19 |
| 6,382,765 | B1 * | 5/2002 | Kanda et al. | 347/23 |
| 6,637,858 | B2 | 10/2003 | Wotton et al. | |
| 6,659,584 | B2 * | 12/2003 | Miura et al. | 347/19 |
| 6,746,096 | B2 * | 6/2004 | Sakamoto et al. | 347/23 |
| 7,651,193 | B2 * | 1/2010 | Kawamoto et al. | 347/22 |
| 7,758,145 | B2 * | 7/2010 | Johnson | 347/19 |
| 2005/0018006 | A1 * | 1/2005 | Im et al. | 347/19 |
| 2005/0052489 | A1 * | 3/2005 | Kim et al. | 347/29 |
| 2005/0264594 | A1 * | 12/2005 | Inde et al. | 347/15 |
| 2006/0092211 | A1 * | 5/2006 | Arakawa et al. | 347/19 |
| 2006/0290735 | A1 * | 12/2006 | Jang | 347/19 |
| 2007/0040864 | A1 * | 2/2007 | Jung et al. | 347/22 |
| 2007/0103512 | A1 * | 5/2007 | Miura et al. | 347/47 |
| 2008/0192085 | A1 * | 8/2008 | Shimazaki | 347/35 |

FOREIGN PATENT DOCUMENTS

| | | |
|---|---|---|
| JP | 2003-145782 | 5/2003 |
| KR | 2006-114269 | 11/2006 |
| KR | 2007-21760 | 2/2007 |

* cited by examiner

*Primary Examiner* — Charlie Peng
(74) *Attorney, Agent, or Firm* — Stanzione & Kim, LLP

(57) ABSTRACT

An inkjet image forming apparatus includes a print head, an ink supply unit, an ink supply flow path connecting the ink supply unit and the print head, an ink supply amount detector which detects the amount of ink supplied through the ink supply flow path, and a controller which controls a maintenance operation of the print head according to the amount of supplied ink detected by the ink supply amount detector. The controller determines the states of nozzles of the print head according to the amount of supplied ink and cleans the nozzles using supersonic waves or performs wiping and spitting of the nozzles, thereby achieving efficient maintenance.

25 Claims, 11 Drawing Sheets

FIG. 4

| Number of Dots | Amount of Supplied Ink (pl) | Number of Encoder Pulses |
|---|---|---|
| 1 | c | p |
| 10 | c X 10 | p X 10 |
| ⋮ | ⋮ | ⋮ |
| 500 | c X 500 | p X 500 |
| ⋮ | ⋮ | ⋮ |

INKJET IMAGE FORMING APPARATUS AND METHOD TO CONTROL THE SAME

CROSS-REFERENCE TO RELATED APPLICATIONS

This application claims priority under 35 U.S.C. §119(a) from Korean Patent Application No. 2007-0061537, filed on Jun. 22, 2007 in the Korean Intellectual Property Office, the disclosure of which is incorporated herein by reference in its entirety.

BACKGROUND OF THE INVENTION

1. Field of the Invention

The present general inventive concept relates to an inkjet image forming apparatus and a method to control the same with an improved maintenance operation of a print head.

2. Description of the Related Art

Recently, attempts have been made to implement high-speed printing using a line printing type inkjet head (array inkjet head), including a nozzle portion having a length in a main scanning direction corresponding to a width of a print medium, instead of using a shuttle type inkjet head. The inkjet head of this inkjet image forming apparatus is fixed on a main body thereof while the print medium is moved in a sub-scanning direction. Thus, the inkjet image forming apparatus has a simple drive unit and can achieve the high-speed printing.

If some nozzles are clogged or a direction of jetting is changed due to foreign substances, it is difficult for the array inkjet head to compensate for these problems since the array inkjet head jets ink at a fixed position, in contrast to the shuttle type inkjet head which reciprocates in the main scanning direction. Thus, it is necessary to perform an efficient maintenance operation on the array inkjet head.

In order for the inkjet image forming apparatus to print high-quality images, a nozzle portion of the inkjet head must be kept in an optimal state, regardless of whether it is of the shuttle or line printing type. To accomplish this, the inkjet image forming apparatus includes a maintenance device to maintain and keep the nozzle portion of the inkjet head in a normal state. The inkjet image forming apparatus generally performs a maintenance operation such as spitting, wiping, and capping through the maintenance device. Here, the term "spitting" refers to jetting ink a number of times at regular time intervals to remove highly viscous ink, the term "wiping" is referred to as wiping off foreign substances from the nozzle portion, and the term "capping" is referred to as providing a cover for the nozzle portion to separate it from the external air.

The nozzle portion of the inkjet image forming apparatus is maintained in a good (clean) state through the maintenance operation. However, in some cases, the nozzles may be seriously clogged, making it difficult to recover the nozzle portion. To solve this problem, inkjet image forming apparatuses include a cleaner using supersonic waves as a part of the maintenance device.

A conventional method to restrict maintenance is to perform maintenance according to the count of dots corresponding to the amount of printing or according to an off time during which a print job has been suspended. To accomplish this, dots are counted for each print job or an off time taken until a print job is resumed after the print job is suspended is counted and spitting and wiping is sequentially performed when the count has reached a threshold set to a value at which maintenance is performed.

The threshold may be affected by the ambient environment of the inkjet image forming apparatus since the threshold is determined from tests. The threshold at which maintenance is performed may be set to be too low or too high depending on the installation environment of the inkjet image forming apparatus. When the threshold is too low, maintenance may be performed more frequently than needed, which increases power consumption and also causes inconvenience that any print job cannot be actually done while the maintenance is performed. On the other hand, when the threshold is too high, a print job may be performed with some nozzles clogged, thereby reducing the print image quality.

The conventional inkjet image forming apparatus performs maintenance regardless of the actual states of nozzles since it uniformly sets the time to perform maintenance of the head in the above manner.

SUMMARY OF THE INVENTION

The foregoing and/or other aspects and utilities of the present general inventive concept may be achieved by providing an inkjet image forming apparatus and a method to control the same, which can control a maintenance operation of a print head according to changes in the flow rate of ink in an ink supply flow path through which ink is supplied to the print head.

Additional aspects and/or advantages of the general inventive concept will be set forth in part in the description which follows and, in part, will be obvious from the description, or may be learned by practice of the general inventive concept.

The foregoing and/or other aspects and utilities of the present general inventive concept may be achieved by providing an inkjet image forming apparatus including a print head to form an image on a print medium, an ink supply unit to supply ink to the print head, an ink supply flow path connecting the ink supply unit and the print head, an ink supply amount detector to detect the amount of ink supplied through the ink supply flow path, and a controller to control a maintenance operation of the print head according to the amount of supplied ink detected by the ink supply amount detector.

When new ink is supplied from the ink supply unit to the print head through the ink supply flow path after the print head experimentally jets ink, the controller may determine that a maintenance operation of the print head is needed if the amount of supplied ink detected by the ink supply amount detector is less than a reference value.

The print head may include a nozzle driver to individually jet ink droplets through each of a plurality of nozzles, and the controller may determine that at least one of the plurality of nozzles is defective and abnormally jets ink if there is a difference between the amount of supplied ink detected by the ink supply amount detector and the amount of ink consumed by the print head.

The controller may clean the print head using supersonic waves if the difference between the detected amount of supplied ink and the consumed amount of ink is great and sequentially performs wiping and spitting of the print head if the difference is not great.

The controller may increase the number of times of spitting of the print head as the difference between the detected amount of supplied ink and the consumed amount of ink increases.

The controller may determine whether or not to perform a maintenance operation of the print head each time a power-on reset is generated to supply power to the apparatus.

The print head may be an array inkjet head that forms, at a fixed position, an image on a print medium using a nozzle portion having a length corresponding to a width of the print medium.

The ink supply amount detector may include an encoder to detect the amount of supplied ink according to rotation of a rotating body.

The encoder may output a pulse signal corresponding to the amount of supplied ink and the controller has a table used to detect the amount of supplied ink using the number of pulses counted in the pulse signal of the encoder.

The encoder may include a rotating blade that is provided in the ink supply flow path to rotate by ink that is supplied to the print head, a rotating shaft with one end coupled to the rotating blade, a rotating plate that is fixed to the other end of the rotating shaft to interlock with the rotating shaft, a light receiving element and a light emitting lamp that are mounted at front and rear sides of the rotating plate, and a buffer element to receive and convert an output of the light receiving element into a pulse signal.

The foregoing and/or other aspects and utilities of the present general inventive concept may also be achieved by providing an inkjet image forming apparatus including a print head including a sub-heater provided on a substrate to heat ink in an ink chamber corresponding to a plurality of nozzles, a temperature sensor, and a nozzle driver to jet ink using a main heater corresponding to the plurality of nozzles, an ink supply unit to supply ink to the print head, an ink supply flow path connecting the ink supply unit and the ink chamber of the plurality of nozzles, an encoder provided in the ink supply flow path to output a pulse signal according to the amount of ink supplied from the ink supply unit to the ink chamber of the plurality of nozzles, and a controller to determine, when new ink is supplied from the ink supply unit to the ink chamber of the plurality of nozzles after ink is experimentally jetted from the print head by controlling the nozzle driver, whether or not a maintenance operation of the plurality of nozzles is needed according to a difference between the amount of ink consumed by the print head and the amount of the new ink detected according to the pulse signal of the encoder.

The controller may heat ink in the ink chamber using the sub-heater if a temperature measured by the temperature sensor is less than a reference jetting temperature appropriate for ink jetting.

The controller may clean the plurality of nozzles using supersonic waves or sequentially performs wiping and spitting of the plurality of nozzles if it is determined that maintenance of the plurality of nozzles is needed.

The foregoing and/or other aspects and utilities of the present general inventive concept may also be achieved by providing a method to control an inkjet image forming apparatus to perform maintenance of a print head having a plurality of nozzles, the method including experimentally jetting ink from the print head; supplying new ink from an ink supply unit to the print head, detecting the amount of ink newly supplied through an ink supply flow path connecting the ink supply unit and the plurality of nozzles of the print head, determining whether or not there is a difference between the detected amount of ink and the amount of ink consumed by the print head, and performing a maintenance operation on the plurality of nozzles if there is a difference between the detected amount of ink and the consumed amount of ink.

The amount of supplied ink may include counting pulses in a pulse signal that an encoder outputs according the number of rotations of a rotating blade that rotates by ink flowing through the ink supply flow path and calculating the amount of supplied ink using a table according to the count of the pulses.

The maintenance operation of the print head may include cleaning the plurality of nozzles using supersonic waves if the difference between the detected amount of ink and the consumed amount of ink is great and sequentially performing wiping and spitting of the plurality of nozzles if the difference is not great.

Wiping and spitting of the plurality of nozzles is sequentially performed, the wiping may be performed once, and the spitting may be performed a number of times set according to the difference between the detected amount of ink and the consumed amount of ink.

A temperature of the print head may be measured before the wiping and spitting of the plurality of nozzles is performed and ink in the print head is heated using a heater if the measured temperature is low.

It may be determined whether or not maintenance of the print head is needed each time a power-on reset is generated to supply power to the apparatus.

The foregoing and/or other aspects and utilities of the present general inventive concept may also be achieved by providing an inkjet image forming apparatus including a print head to form an image on a print medium, an ink supply unit to supply ink to the print head, and a controller to control a maintenance operation of the print head according to an amount of ink supplied from the ink supply unit to the print head.

The controller may control the print head to eject ink in a printing operation to form the image on the print medium, and to eject ink in a non-printing operation, and control the maintenance operation of the print head according to the amount of the ink supplied to the print head in the non-printing operation.

The print head may include a plurality of nozzles, and the controller may control the print head to eject ink through all of the plurality of nozzles in a test operation, and control the maintenance operation of the print head according to the amount of the ink supplied to the print head in the test operation.

The print head may include a plurality of nozzles, and the controller may control the print head to eject ink through a portion of the plurality of nozzles according to image data to form an image of the image data on the print medium in an image forming operation, and control the print head to eject ink through the plurality of nozzles in a test operation, and control the maintenance operation of the print head according to the amount of the ink supplied to the print head in the test operation.

The print head ejects ink to form the image on the print medium according to image data and eject ink according to test data not relating to the image data, and the controller may control the maintenance operation according to the amount of ink supplied when the print head ejects ink according to the test data not relating to the image data The maintenance operation may include a plurality of sub-maintenance operations, and the controller may control the number of times to perform each of the plurality of sub-maintenance operation according to the amount of ink supplied to the print head.

The maintenance operation may include a first maintenance operation and a second maintenance operation, and the controller may selectively perform at least one of the first maintenance operation and the second maintenance operation according to the an amount of ink supplied to the print head.

The foregoing and/or other aspects and utilities of the present general inventive concept may also be achieved by providing a inkjet image forming apparatus including a print head to form an image on a print medium, an ink supply amount detector to detect the amount of ink supplied through the ink supply flow path, and a controller to control a maintenance operation of the print head according to the detected amount of ink supplied to the print head.

The foregoing and/or other aspects and utilities of the present general inventive concept may also be achieved by providing an inkjet image forming apparatus including a print head to form an image on a print medium, an ink supply unit to supply ink to the print head, an ink supply amount detector to detect the amount of ink supplied from the ink supply unit to the print head, and a controller to control a maintenance operation of the print head according to the detected amount of ink.

BRIEF DESCRIPTION OF THE DRAWINGS

These and/or other aspects and utilities of the present general inventive concept will become apparent and more readily appreciated from the following description of the embodiments, taken in conjunction with the accompanying drawings of which:

FIG. 4 illustrates a table created according to association between the number of dots, the amount of supplied ink, and the number of encoder pulses.

DETAILED DESCRIPTION OF THE PREFERRED EMBODIMENTS

Figure 1A:
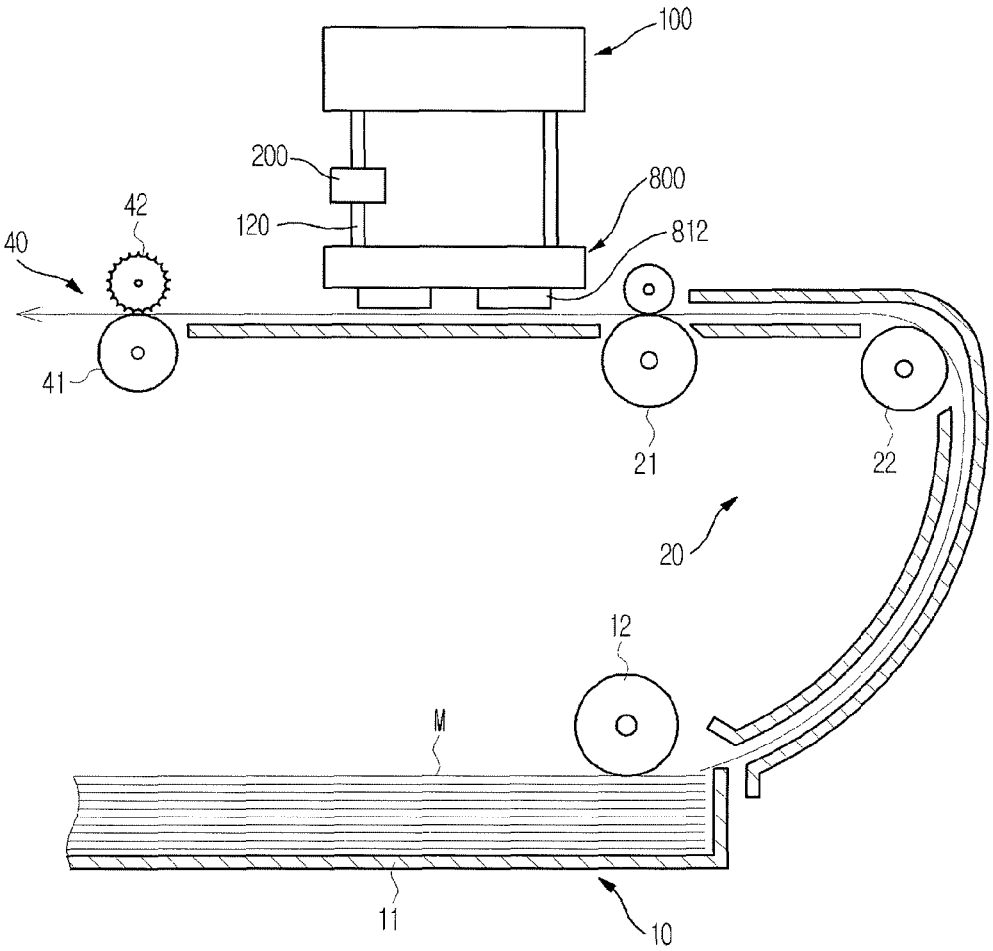
FIG. 1A illustrates a configuration of an inkjet image forming apparatus according to an embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

First, a description will be given of an image forming apparatus and a method to control the same according to an embodiment of the present general inventive concept.

FIG. 1A illustrates a configuration of an inkjet image forming apparatus according to an embodiment of the present general inventive concept.

As illustrated in FIG. 1A, the inkjet image forming apparatus includes a medium feed unit 10 to feed a print medium M, a conveying unit 20 to convey the print medium M, a print head 800 to form an image on the print medium conveyed by the conveying unit 20, an ink supply unit 100 to supply ink to the print head 800, and a medium eject unit 40 to eject the printed print medium outside the image forming apparatus.

The medium feed unit 10 includes a medium tray 11 in which print media M are stacked and a pickup roller 12 to pick up the print media stacked in the medium tray 11 one by one. The conveying unit 20 conveys the print medium, picked up by the pickup roller 12, below the print head 800. The conveying unit 20 may include a feeding roller 21 mounted at the entrance side of the print head 800 and an auxiliary roller 22 mounted between the feeding roller 21 and the pickup roller 12. In this embodiment, the print head 800 may be an array print head including a nozzle portion that has a length corresponding to the width of a print medium. The print head 800 may be disposed at a fixed position to eject ink toward the print medium M to print an image on the print medium.

Figure 1B:
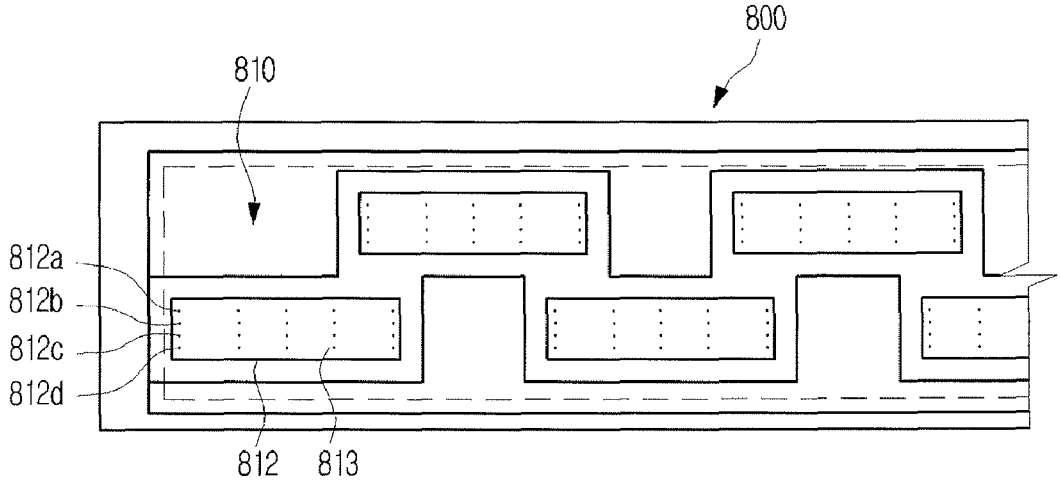
FIG. 1B illustrates a nozzle portion of a print head in the inkjet image forming apparatus of FIG. 1A.

FIG. 1B illustrates a nozzle portion of the print head 800 in the inkjet image forming apparatus of FIG. 1A. Referring to FIGS. 1A and 1B, the nozzle portion 810 includes a plurality of head chips 812 arranged along a width direction of the nozzle portion 810 in a zigzag pattern. Each of the head chips 812 includes a plurality of nozzles 813 formed to jet ink. The head chip 812 may include a plurality of rows of nozzles 812*a*, 812*b*, 812*c*, and 812*d*. The nozzle rows 812*a*, 812*b*, 812*c*, and 812*d* may jet ink of the same or different colors (for example, yellow, magenta, cyan, and black). When the print head 800 is constructed so as to jet ink of different colors, the ink supply unit 100 is individually provided for each of the colors.

The print head 800 has a channel unit (not illustrated) to guide ink supplied from the ink supply unit 100 and ink channels (not illustrated) are formed in the channel unit to uniformly supply ink to the nozzles 813 of the print head 800.

The medium eject unit 40 may include an eject roller 41 mounted downstream of the print head 800 in a conveyance direction of the print medium M and a star wheel 42 mounted opposite the eject roller 41. The star wheel 42 prevents the print medium M from contacting the nozzle portion 810 when the print medium M passes below the nozzle portion 810 and prevents changes in the interval between the print medium M and the nozzle portion 810.

The ink supply unit 100 is connected to the channel unit of the print head 800 through an ink supply flow path 120 through which ink is supplied.

An ink supply amount detector 200 is provided in the ink supply flow path 120 to detect the amount of ink supplied through the ink supply flow path 120. The ink supply amount detector 200 may be a flow rate sensor to detect the amount of ink supplied through the ink supply flow path 120 according to the flow rate of ink that flows through the ink supply flow path 120. A method to detect the amount of supplied ink according to rotation of a rotating body can be used, thereby reducing manufacturing costs.

The ink supply unit 100 may be integrated with the print head 800 into a cartridge or may be provided in a separate set from the print head 800.

The ink supply unit 100 may be constructed to drive an ink pump motor (not illustrated) to pump ink stored in an ink tank into the ink supply flow path 120 or may be constructed with an ink tank mounted at a position higher than the print head 800 to allow ink to be automatically supplied from the ink tank into the ink supply flow path 120 without using any power source.

The print head 800 may be of a thermal type which generates bubbles in ink using a heat source and jets ink droplets by an expanding force (or pressure) of the bubbles. A detailed description of the thermal type print head is omitted since a conventional print head can be used as the print head 800. A conventional thermal type print head is described in U.S. Pat. No. 4,8812,595.

Figure 2:
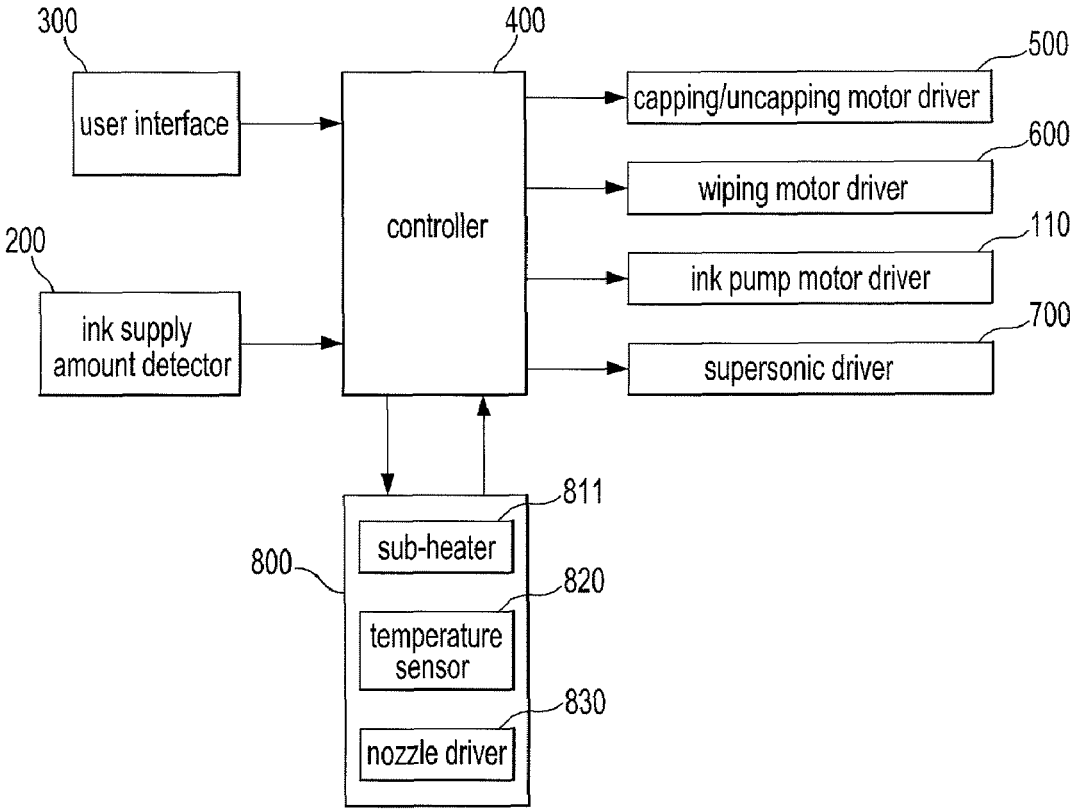
FIG. 2 is a control block diagram illustrating an inkjet image forming apparatus according to an embodiment of the present general inventive concept.

As illustrated in FIGS. 1A, 1B, and 2, the print head 800 includes a sub-heater 811 provided on a substrate including the nozzles 813, a temperature sensor 820 to measure and provide a temperature of each head chip 812 to a controller 400, and a nozzle driver 830 to receive a control command, which is to control a heat source (main heater) corresponding to the nozzles 813 of the nozzle portion 810, from the controller 400 and then to drive the corresponding nozzles to jet ink droplets through the nozzles.

The sub-heater 811 heats the substrate to increase the temperature of ink filled in the ink chamber in the head chip 812. The temperature sensor 820 changes its electrical resistance according to the temperature of the head chip and applies a corresponding output voltage to the controller 400. The controller 400 controls the sub-heater 811 and the main heater using a fire-pulse current. A conventional driving method can be used to control ejection of the ink in the print head 800. Accordingly, a detailed description of a method to drive the main and sub-heaters is omitted. An example of the drive method is described in Korean Patent Application Publication No. 10-2006-0114269.

The inkjet image forming apparatus according to the general inventive concept includes a maintenance device including a capping/uncapping motor driver 500, a wiping motor driver 600, and a supersonic driver 700. The capping/uncapping motor driver 500 drives a motor (not illustrated) to control the operation of a cap to perform capping or uncapping. The wiping motor driver 600 drives a wiping motor (not illustrated) to control an operation of a wiper to wipe off foreign substances attached to the nozzles 813. The supersonic driver 700 generates supersonic waves to clean the nozzles 813.

Examples of using this maintenance device are Korean Patent Application Publication No. 10-2007-0021760 and U.S. Pat. No. 6,637,858.

A user interface 300 provides a print command from the user to the controller 400. When a power-on reset to supply power to the apparatus is generated using a power switch (not shown), the controller 400 performs an operation to experimentally jet ink from the print head 800. This operation is performed through spitting which is to test the states of the nozzles of the print head 800.

An ink chamber in the head chip is then filled with new ink in the same amount as ink discharged from the ink chamber through the nozzles when spitting was performed. The ink supply unit 100 supplies supplementary ink to be filled into the ink chamber through the ink supply flow path 120. Therefore, by checking the amount of the ink supplied through the ink supply flow path 120, the controller 400 can determine whether or not there are clogged nozzles which have become unable to normally jet ink, and a ratio of the number of the clogged nozzles to the total number of nozzles. An ink pump motor driver 110 can be used to forcibly supply ink from the ink supply from the ink supply unit 100 to the print head 800 through the ink supply flow path 120.

The controller 400 recognizes the state of nozzles based on the amount of supplied ink detected by the ink supply amount detector 200 during spitting and determines whether or not to perform maintenance and the number of repetitions of maintenance.

FIGS. 3A to 3E illustrate an ink supply amount detector 200 according to the general inventive concept. Referring to FIGS. 1A through 3E, the ink supply amount detector 200 may use an encoder to generate a pulse signal according to rotation of a rotating shaft in the ink supply amount detector 200. The pulse signal can be transmitted to the controller 400 to perform the maintenance operation.

The ink supply amount detector 200 includes a rotating member 210 rotatably mounted in the ink supply flow path 120. The rotating member 210 includes a plurality of rotating blades 211, each of which is semicircular with one curved surface, and a rotating shaft 212 to which the plurality of rotating blades are coupled at regular intervals. The rotating blades 211 rotate by ink that flows in directions shown by arrows in FIG. 3A. The flowing ink causes rotation of the rotating shaft 212.

Figure 3A:
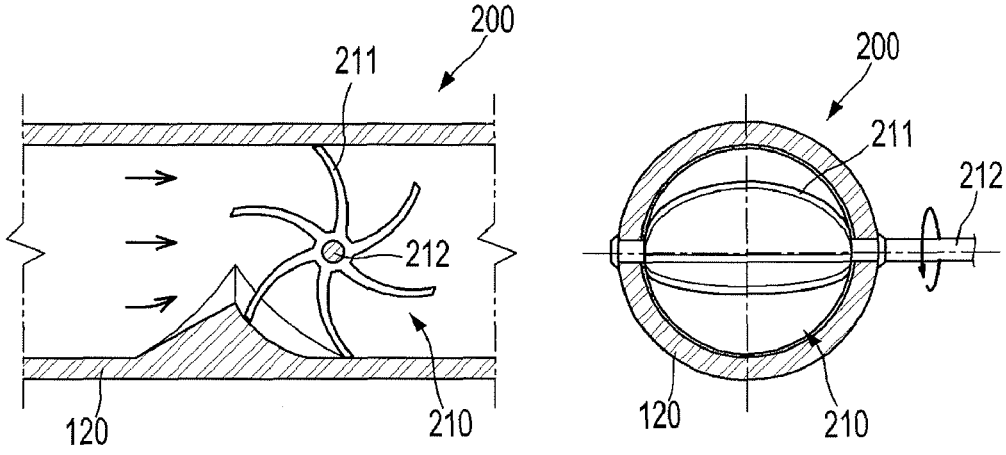
FIG. 3A illustrates rotating blades of an ink supply amount detector according to an embodiment of the present general inventive concept.
Figure 3B:
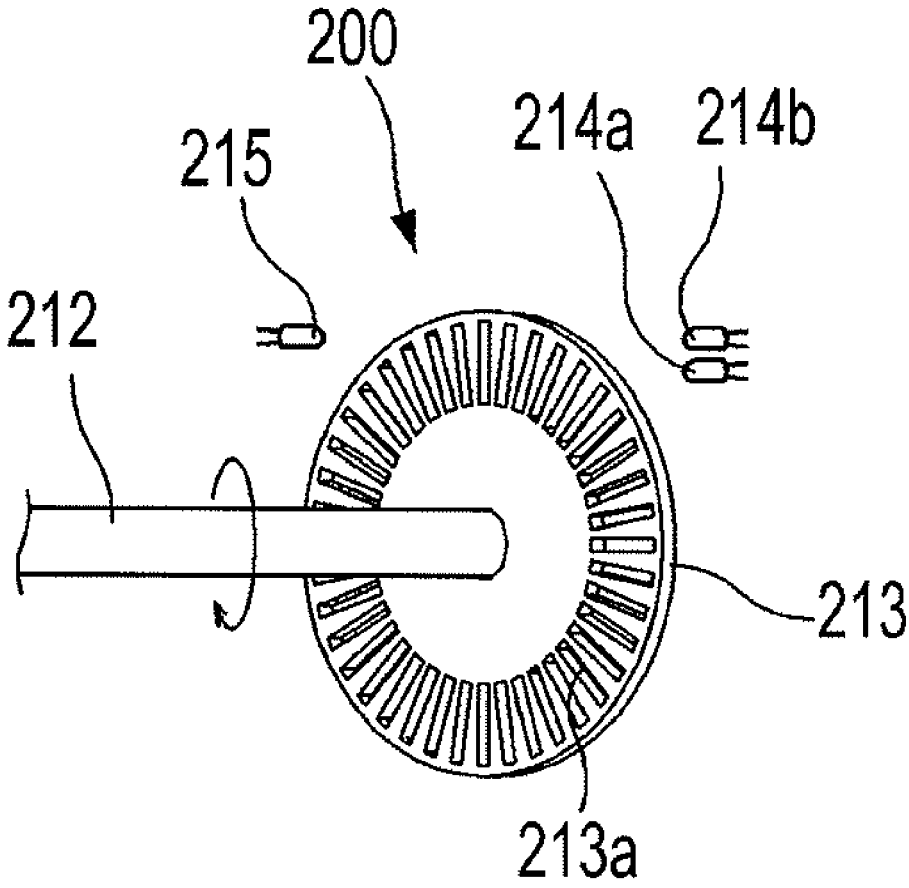
FIG. 3B illustrates a rotating plate, light receiving elements, and a light emitting lamp of the ink supply amount detector according to an embodiment of the present general inventive concept.
Figure 3C:
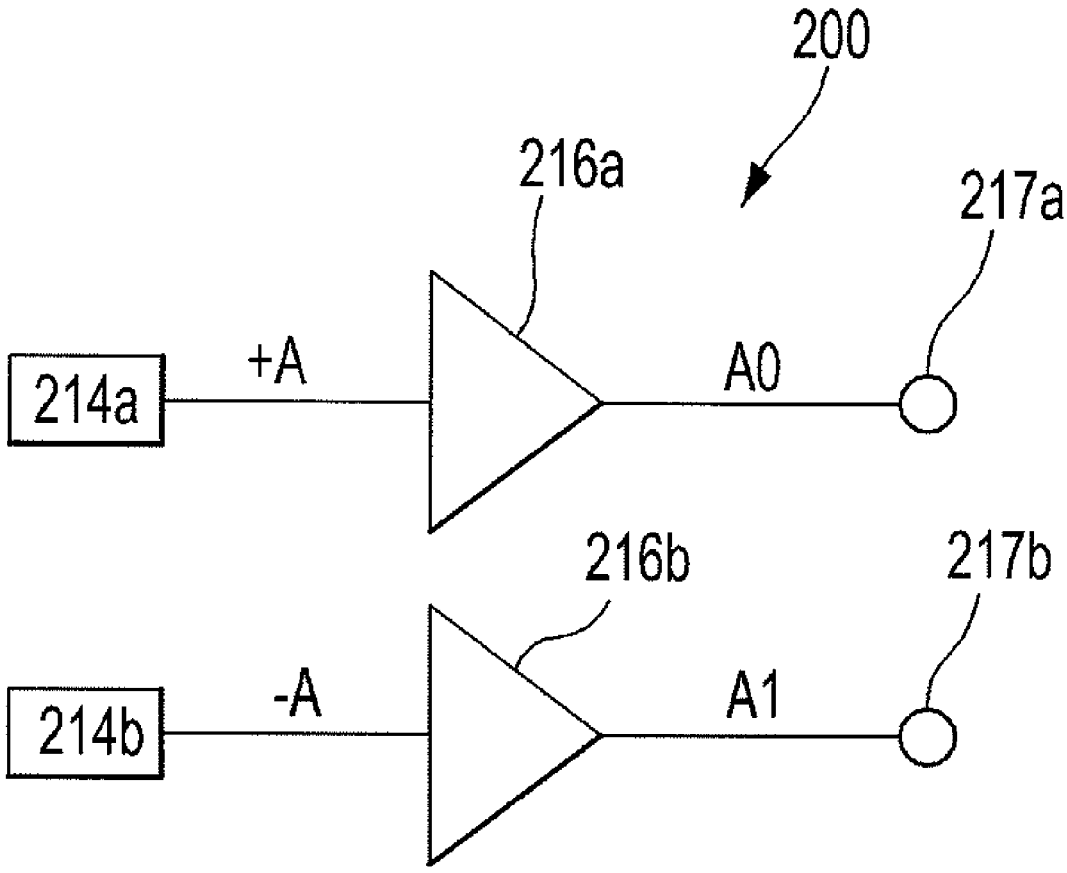
FIG. 3C illustrates electrical connections between buffer elements and light receiving elements of the ink supply amount detector according to an embodiment of the present general inventive concept.

As illustrated in FIG. 3B, a rotating plate 213 is fixed to an opposite end of the rotating shaft 212. The rotating plate 213 rotates together with the rotating shaft 212. A plurality of slits 213*a* are formed along a circumferential direction of the rotating plate 213. Light receiving elements 214*a* and 214*b* and a light emitting lamp 215 are mounted at a distance from each other at front and rear sides of the rotating plate 213, respectively. A light beam emitted by the light emitting lamp 215 passes through the slits 213*a* of the rotating plate 213 to reach the light receiving elements 214*a* and 214*b* in different phases. Referring to FIG. 3C, outputs of the light receiving elements 214*a* and 214*b* are applied to buffer elements 216*a* and 216*b*, respectively.

Figure 3D:
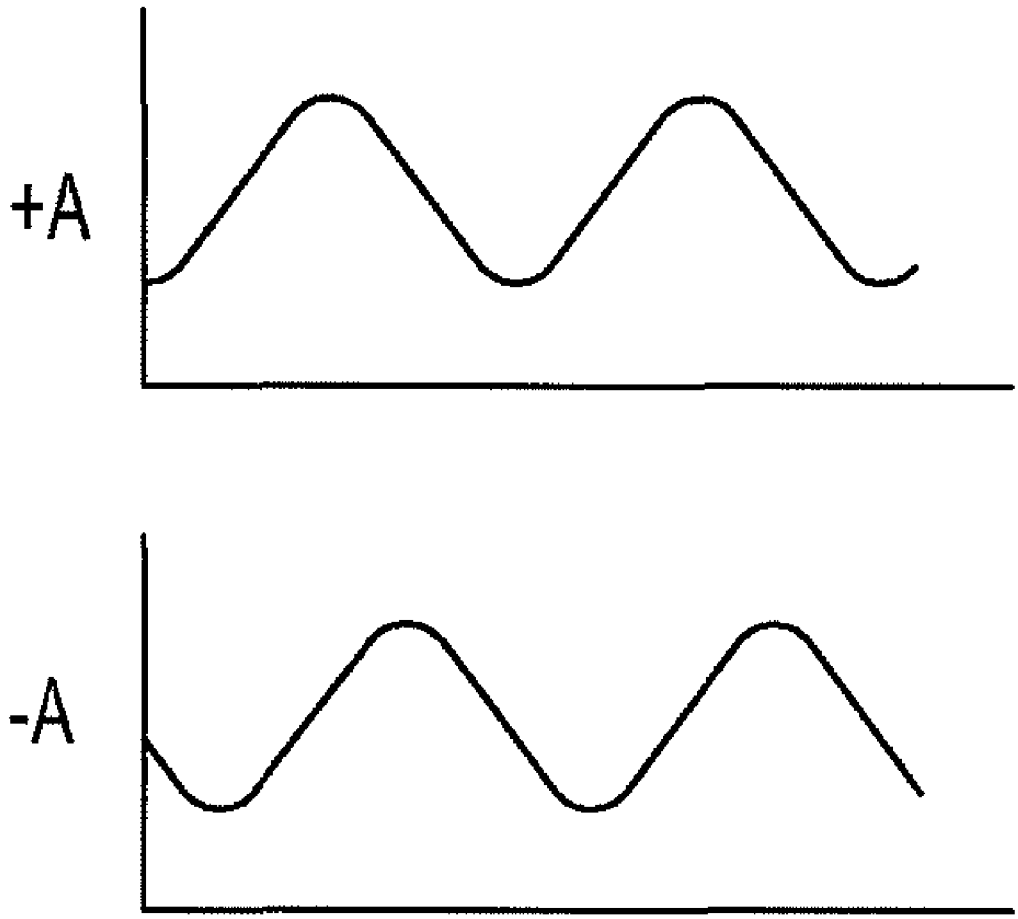
FIG. 3D illustrates output signals of the light receiving elements of the ink supply amount detector according to an embodiment of the present general inventive concept.
Figure 3E:
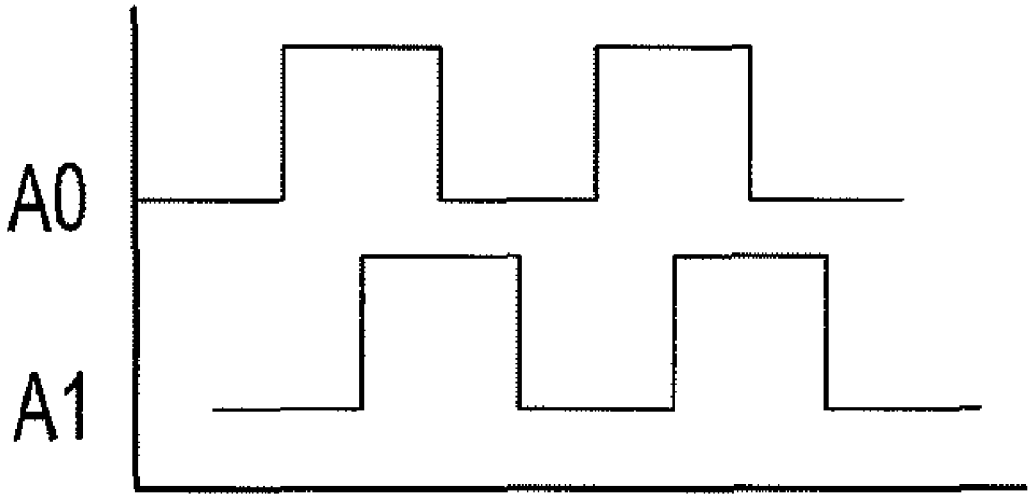
FIG. 3E illustrates output signals of the buffer elements of the ink supply amount detector according to an embodiment of the present general inventive concept.

Output terminals 217*a* and 217*b* of the buffer elements 216*a* and 216*b* are electrically connected to input terminals of the controller 400. The first buffer element 216*a* receives and converts an output +A of the first light receiving element 214*a* into a pulse signal A0 and provides the pulse signal A0 to the controller 400. The second buffer element 216*b* receives and converts an output −A of the second light receiving element 214*b* into a pulse signal A1 and provides the pulse signal A1 to the controller 400. Here, the output −A of the second light receiving element 214*b* has a phase difference of 90° from the output +A of the first light receiving element 214*a* as illustrated in FIG. 3D.

In this manner, the pulse signal of two channels A0 and A1 is provided to the controller 400 as the rotating shaft 212 rotates in conjunction with the rotation of the rotating blades 211. The controller 400 counts the number of pulses of the encoder pulse signal of the encoder and can determine the amount of supplied ink based on the counted number of pulses using a table of FIG. 4.

Referring to FIG. 4, the table illustrates that, when 500 dots are printed, the amount of ink supplied to the print head may be the unit amount of supplied ink "c" times the number of dots "500," that is, c×500, and the number of corresponding encoder pulses generated by the ink supply amount detector is the unit number of pulses "p" times the number of dots "500," that is, p×500.

In this embodiment, the states of nozzles are tested or checked after spitting is performed at each node with ink in the amount of ink corresponding to 500 dots. The node represents a period of time, a maintenance period, or a maintenance checking period. The amount of ink consumed by one head chip when spitting of one dot is performed at each nozzle is "nc" pl under the assumption that one head chip has "n" nozzles and ink in the unit amount of supplied ink "c" pl is needed to perform spitting of one dot at each nozzle. Accordingly, the amount of ink consumed by one head chip when spitting of 500 dots is performed is "500nc" pl. The amount of ink consumed by an array inkjet image forming apparatus with the "i" number of head chips when spitting of 500 dots is performed at each nozzle is "500inc" pl.

The ink supply unit 100 supplies new ink in the same amount as consumed by the spitting to the print head 800 through the ink supply flow path 120. The controller 400 determines the amount of ink actually supplied through the ink supply flow path 120 from the number of encoder pulses received from the ink supply amount detector 200 and determines the states of the nozzles by comparing the determined amount of ink with a reference value. If the amount of supplied ink is less than the reference value, the controller 400 determines that some nozzles are defective so that their ink jetting operations are abnormal and that the number of defective nozzles, which have been clogged, increases as the amount of supplied ink decreases below the reference value.

The controller 400 performs an operation to clean the nozzles using supersonic waves if the number of defective nozzles is large and performs spitting according to the number of defective nozzles if the number of defective nozzles is too small to perform cleaning using supersonic waves.

Figure 5A:
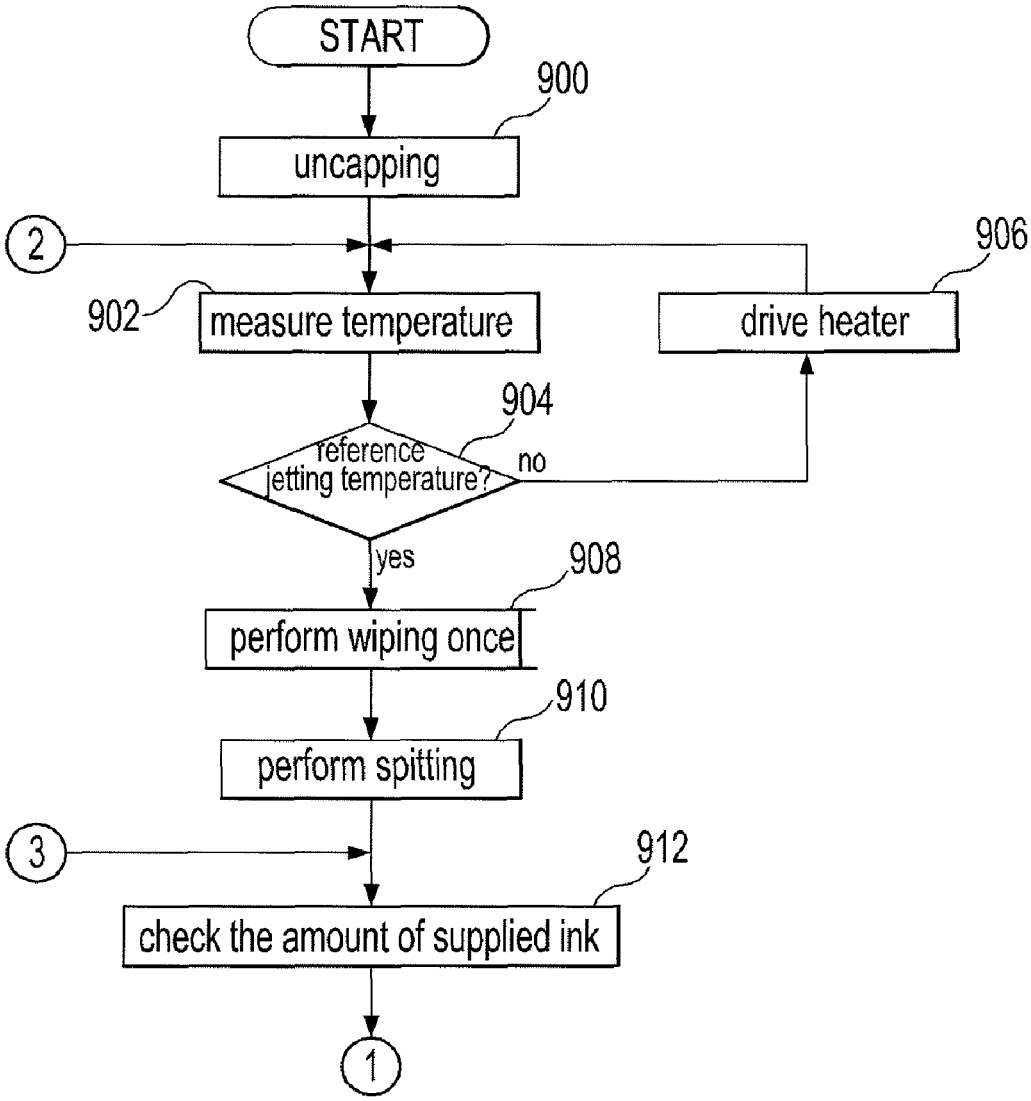
FIGS. 5A and 5B illustrate a method to control an inkjet image forming apparatus according to an embodiment of the present general inventive concept.
Figure 5B:
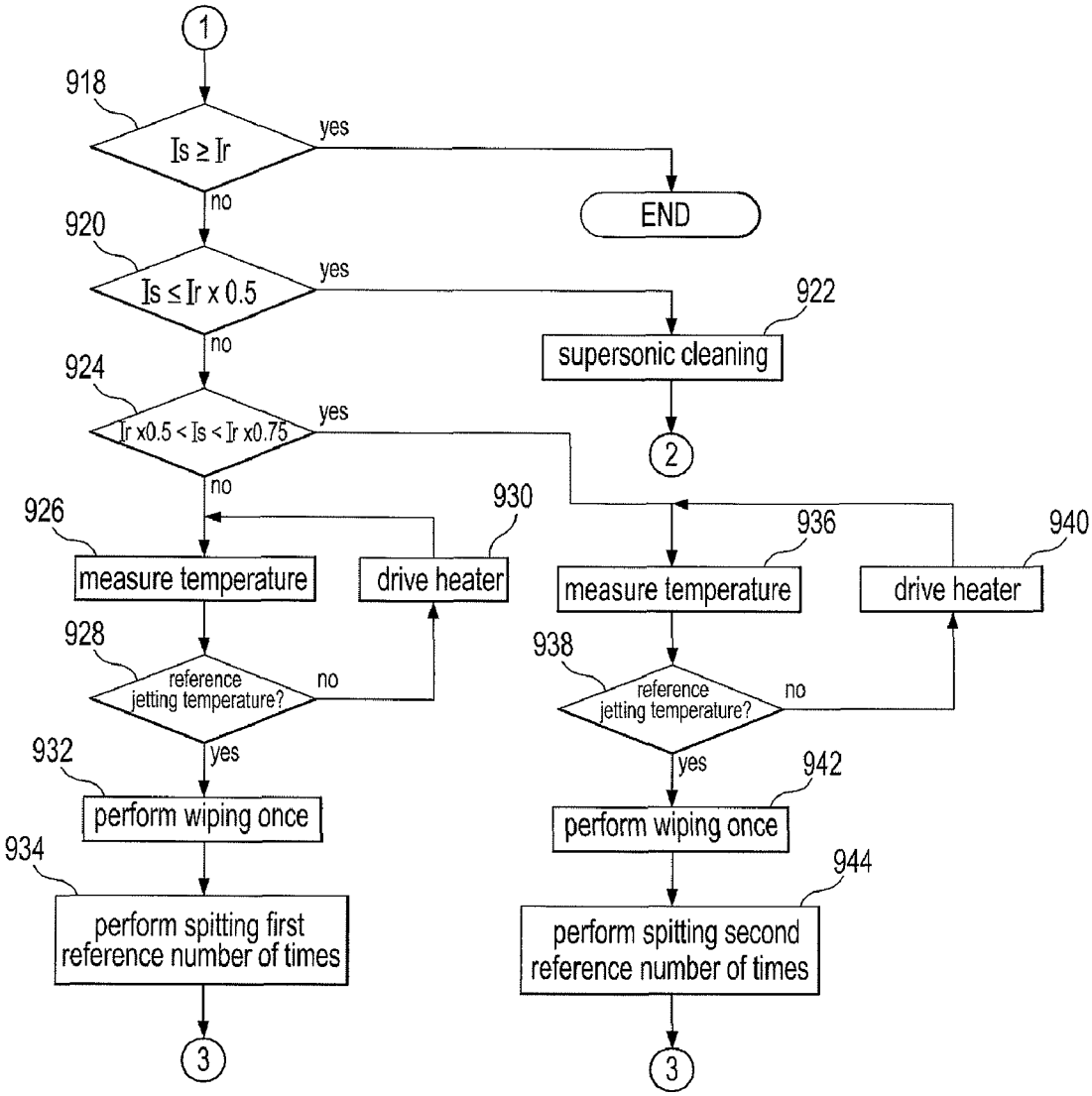

An operation of the array inkjet image forming apparatus to perform maintenance when a power-on reset is generated at the apparatus will now be described with reference to FIGS. 5A and 5B.

Referring to FIGS. 1A through 5B, when power is supplied to the apparatus, the capping/uncapping motor driver 500 activates a cap of the maintenance device under control of the controller 400 to perform uncapping to expose the nozzles 813 of the print head 800 at operation 900.

The temperature sensor 820 then measures and provides a temperature of each head chip 812 to the controller 400 at operation 902. The controller 400 determines whether or not the measured temperature of the head chip is equal to a reference jetting temperature appropriate for ink jetting at operation 904 and activates the sub-heater 811 if the measured temperature of the head chip is not equal to the reference jetting temperature at operation 906. If it is determined that the measured temperature of the head chip is equal to the reference jetting temperature, the controller 400 activates the wiping motor to perform an operation to clean the nozzles with the wiper once at operation 908.

The controller 400 then activates the heat source (main heater) of the nozzle driver 830 to perform spitting to jet ink at each nozzle of the head chip at operation 910. New ink in the same amount as jetted by the spitting is supplied to and filled into the head chip from the ink supply unit 100 through the ink supply flow path 120. Here, the ink supply amount detector 200 applies a pulse signal, corresponding to the amount of ink supplied through the ink supply flow path 120, to the controller 400. The controller 400 checks the amount of supplied ink based on the received pulse signal at operation 912.

Here, the controller 400 can calculate the amount of supplied ink corresponding to the accumulated number of pulses of the pulse signal using the table of FIG. 4.

The controller 400 then determines whether or not the calculated amount of supplied ink "Is" is equal to or greater than a preset reference amount of ink "Ir" at operation 918. If it is determined that the calculated amount of supplied ink is equal to or greater than the reference amount of ink, the controller 400 determines that all nozzles are in a normal ink jetting state and thus terminates the operation to prepare for a print job without performing a maintenance operation. Thereafter, the controller 400 performs a print job in response to a print command.

If it is determined in operation 918 that the calculated amount of supplied ink "Is" is less than the reference amount of ink "Ir" to indicate that some nozzles are defective, the controller 400 determines whether or not the calculated amount of supplied ink "Is" is less than or equal to 50% of the reference amount of supplied ink "Ir," that is, $Is \leqq Ir \times 0.5$, at operation 920. If it is determined that the calculated amount of supplied ink "Is" is less than or equal to 50% of the reference amount of supplied ink "Ir," that is, $Is \leqq Ir \times 0.5$, the controller 400 determines that the number of defective nozzles, which have been clogged, is greater than a reference and thus activates the supersonic driver 700 to perform supersonic washing to clean the nozzles using supersonic waves at operation 922. The controller 400 then returns to operation 902.

If it is determined in operation 920 that the calculated amount of supplied ink "Is" is greater than 50% of the reference amount of ink "Ir," that is, $Is > Ir \times 0.5$, the controller 400 determines that it is necessary to perform spitting according to the ratio of defective nozzles, which have been clogged, although the number of the defective nozzles is not too greater than a reference, and then determines whether or not the calculated amount of supplied ink "Is" is greater than 50% of the reference amount of supplied ink "Ir" and less than 75% of "Ir," that is, $Ir \times 0.5 < Is < Ir \times 0.75$, at operation 924.

If it is determined in operation 924 that the calculated amount of supplied ink "Is" is within the range greater than 50% of the reference amount of ink "Ir" and less than 75% of "Ir," that is, $Ir \times 0.5 < Is < Ir \times 0.75$, the controller 400 measures a temperature of the head chip 812 using the temperature sensor 820 at operation 926 and then determines whether or not the measured temperature of the head chip is equal to the reference jetting temperature at operation 928. If the measured temperature of the head chip is less than the reference jetting temperature, the controller 400 heats ink in the ink chamber using the sub-heater 811 at operation 930.

If the measured temperature of the head chip is equal to the reference jetting temperature, the controller 400 activates the wiping motor driver 600 to perform wiping to clean the nozzles with the wiper at operation 932 and then activates the nozzle driver 830 to perform spitting a first preset number of times (for example, 150 times). Here, in the case where color ink is used, an operation of spitting 50 times is repeated three times for each color so that spitting is performed a total of 150 times for each color at operation 934. Then, the controller 400 proceeds to operation 912 and performs the subsequent operations.

If it is determined in operation 924 that the calculated amount of ink "Is" is not within the range greater than 50% of the reference amount of ink "Ir" and less than 75% of "Ir", the controller 400 measures a temperature of the head chip 812 using the temperature sensor 820 at operation 936 and then determines whether or not the measured temperature of the head chip is equal to the reference jetting temperature at operation 938. If the measured temperature of the head chip is less than the reference jetting temperature, the controller 400 heats ink in the ink chamber using the sub-heater 811 at operation 940. If the measured temperature of the head chip is equal to the reference jetting temperature, the controller 400 activates the wiping motor driver 600 to perform wiping to clean the nozzles with the wiper at operation 942 and then activates the nozzle driver 830 to perform spitting a second preset number of times (for example, 600 times) greater than the first preset number of times. Here, in the case where color ink is used, an operation of spitting 300 times is repeated twice for each color so that spitting is performed a total of 600 times for each color at operation 944. Then, the controller 400 proceeds to operation 912 and performs the subsequent operations.

As is apparent from the above description, the present general inventive concept provides an inkjet image forming apparatus and a method to control the same with a variety of features and advantages. For example, whether or not to perform maintenance can be determined according to the amount of ink detected in a process of experimentally jetting ink from a print head when a power-on reset is generated. Thus, there is no need to perform unnecessary maintenance on the print head and the number of times of spitting of the print head can be determined appropriately, thereby achieving efficient maintenance.

Although a few embodiments of the present general inventive concept have been shown and described, it would be appreciated by those skilled in the art that changes may be made in these embodiments without departing from the principles and spirit of the general inventive concept, the scope of which is defined in the claims and their equivalents.

What is claimed is:

1. An inkjet image forming apparatus comprising:

a print head to form an image on a print medium;

an ink supply unit to supply ink to the print head;

an ink supply flow path to connect the ink supply unit and the print head;

an ink supply amount detector to detect the amount of ink supplied to print head; and a controller to control a maintenance operation of the print head according to the detected amount of ink supplied to the print head, wherein the ink supply amount detector includes an encoder to detect the amount of supplied ink according to rotation of a rotating body thereof by ink flowing in the ink supply flow path.

2. The inkjet image forming apparatus according to claim 1, wherein, when new ink is supplied from the ink supply unit to the print head through the ink supply flow path after the print head experimentally jets ink, the controller determines that the maintenance operation of the print head is needed if the amount of supplied ink detected by the ink supply amount detector is less than a reference value.

3. The inkjet image forming apparatus according to claim 1, wherein:

the print head includes a nozzle driver to individually jet ink droplets through each of a plurality of nozzles; and the controller determines that at least one of the plurality of nozzles is defective and abnormally jets ink if there is a difference between the amount of supplied ink detected by the ink supply amount detector and the amount of ink consumed by the print head.

4. The inkjet image forming apparatus according to claim 3, wherein the controller cleans the print head using supersonic waves if the difference between the detected amount of supplied ink and the consumed amount of ink is greater than a reference and sequentially performs wiping and spitting of the print head as the maintenance operation if the difference is not greater than the reference.

5. The inkjet image forming apparatus according to claim 4, wherein the controller increases the number of times of spitting of the print head as the difference between the detected amount of supplied ink and the consumed amount of ink increases.

6. The inkjet image forming apparatus according to claim 1, wherein the controller determines whether to perform the maintenance operation of the print head when a power-on reset is generated to supply power to the apparatus.

7. The inkjet image forming apparatus according to claim 1, wherein the print head is an array inkjet head disposed at a fixed position to form an image on a print medium using a nozzle portion having a length corresponding to a width of the print medium.

8. The inkjet image forming apparatus according to claim 1, wherein:

the encoder outputs a pulse signal corresponding to the amount of supplied ink; and the controller has a table used to detect the amount of supplied ink using the number of pulses counted in the pulse signal of the encoder.

9. The inkjet image forming apparatus according to claim 1, wherein the encoder includes:

a rotating blade that is provided in the ink supply flow path to rotate by ink that is supplied to the print head;

a rotating shaft with one end coupled to the rotating blade;

a rotating plate that is fixed to the other end of the rotating shaft to interlock with the rotating shaft;

a light receiving element and a light emitting lamp that are mounted at front and rear sides of the rotating plate; and a buffer element to receive and convert an output of the light receiving element into a pulse signal.

10. An inkjet image forming apparatus comprising:

a print head including a sub-heater provided on a substrate to heat ink in an ink chamber corresponding to a plurality of nozzles, a temperature sensor, and a nozzle driver to jet ink using a main heater corresponding to the plurality of nozzles;

an ink supply unit to supply ink to the print head;

an ink supply flow path to connect the ink supply unit and the ink chamber of the plurality of nozzles;

an encoder provided in the ink supply flow path to output a pulse signal according to the amount of ink supplied from the ink supply unit to the ink chamber of the plurality of nozzles; and a controller to determine, when new ink is supplied from the ink supply unit to the ink chamber of the plurality of nozzles after ink is jetted from the print head by controlling the nozzle driver, whether or not a maintenance operation of the plurality of nozzles is needed according to a difference between the amount of ink consumed by the print head and the amount of the new ink detected according to the pulse signal of the encoder, wherein the encoder includes a rotating part to rotate by ink flowing in the ink supply flow path.

11. The inkjet image forming apparatus according to claim 10, wherein the controller heats ink in the ink chamber using the sub-heater if a temperature measured by the temperature sensor is less than a reference jetting temperature appropriate for ink jetting.

12. The inkjet image forming apparatus according to claim 10, wherein the controller cleans the plurality of nozzles using supersonic waves or sequentially performs wiping and spitting of the plurality of nozzles if it is determined that maintenance of the plurality of nozzles is needed.

13. A method to control an inkjet image forming apparatus to perform maintenance of a print head having a plurality of nozzles, the method comprising:

experimentally jetting ink from the print head;

supplying new ink from an ink supply unit to the print head;

detecting the amount of ink newly supplied through an ink supply flow path connecting the ink supply unit and the plurality of nozzles of the print head;

determining whether there is a difference between the detected amount of ink and the amount of ink consumed by the print head; and performing a maintenance operation on the plurality of nozzles if there is a difference between the detected amount of ink and the consumed amount of ink, wherein the detecting of the amount of supplied ink includes using an encoder to detect the amount of supplied ink according to rotation of a rotating body thereof by ink flowing in the ink supply flow path.

14. The method according to claim 13, wherein the detecting of the amount of supplied ink includes counting pulses in a pulse signal that an encoder outputs according the number of rotations of a rotating blade that rotates by ink flowing through the ink supply flow path and calculating the amount of supplied ink using a table according to the count of the pulses.

15. The method according to claim 13, wherein the performing of the maintenance operation of the print head includes cleaning the plurality of nozzles using supersonic waves if the difference between the detected amount of ink and the consumed amount of ink is great and sequentially performing wiping and spitting of the plurality of nozzles if the difference is not great.

16. The method according to claim 15, wherein, when wiping and spitting of the plurality of nozzles is sequentially performed as the maintenance operation, the wiping is performed once and the spitting is performed a number of times set according to the difference between the detected amount of ink and the consumed amount of ink.

17. The method according to claim 14, wherein a temperature of the print head is measured before the wiping and spitting of the plurality of nozzles is performed and ink in the print head is heated using a heater if the measured temperature is low.

18. The method according to claim 13, wherein it is determined whether or not maintenance of the print head is needed each time a power-on reset is generated to supply power to the apparatus.

19. An inkjet image forming apparatus comprising:

a print head to form an image on a print medium;

an ink supply unit to supply ink to the print head;

an ink supply flow path to connect the ink supply unit and the print head;

a controller to control a maintenance operation of the print head according to an amount of ink supplied from the ink supply unit to the print head; and an ink supply amount detector including an encoder to detect the amount of ink supplied according to rotation of a rotating body within the ink supply amount detector by ink flowing in the ink supply path.

20. The inkjet image forming apparatus according to claim 19, wherein the controller controls the print head to eject ink in a printing operation to form the image on the print medium, and to eject ink in a non-printing operation, and controls the maintenance operation of the print head according to the amount of the ink supplied to the print head in the non-printing operation.

21. The inkjet image forming apparatus according to claim 19, wherein:

the print head comprises a plurality of nozzles; and the controller controls the print head to eject ink through all of the plurality of nozzles in a test operation, and controls the maintenance operation of the print head according to the amount of the ink supplied to the print head in the test operation.

22. The inkjet image forming apparatus according to claim 19, wherein:

the print head comprises a plurality of nozzles; and the controller controls the print head to eject ink through a portion of the plurality of nozzles according to image data to form an image of the image data on the print medium in an image forming operation, controls the print head to eject ink through the plurality of nozzles in a test operation, and controls the maintenance operation of the print head according to the amount of the ink supplied to the print head in the test operation.

23. The inkjet image forming apparatus according to claim 1, wherein:

the print head ejects ink to form the image on the print medium according to image data and ejects ink according to test data not relating to the image data; and the controller controls the maintenance operation according to the amount of ink supplied when the print head ejects ink according to the test data not relating to the image data.

24. The inkjet image forming apparatus according to claim 1, wherein:

the maintenance operation comprises a plurality of sub-maintenance operations; and the controller controls the number of times to perform each of the plurality of sub-maintenance operation according to the an amount of ink supplied to the print head.

25. The inkjet image forming apparatus according to claim 1, wherein:

the maintenance operation comprises a first maintenance operation and a second maintenance operation; and the controller selectively performs the first maintenance operation and the second maintenance operation according to the an amount of ink supplied to the print head.

* * * * *